US005802616A

United States Patent [19]

Watson

[11] Patent Number: 5,802,616

[45] Date of Patent: Sep. 8, 1998

[54] FOLDING HAT WITH STIFF SURROUNDING BRIM

[76] Inventor: S. Gene Watson, P.O. Box 5302, Carefree, Ariz. 85377

[21] Appl. No.: 822,282

[22] Filed: Mar. 20, 1997

[51] Int. Cl.[6] ..... A42B 1/20

[52] U.S. Cl. ..... 2/175.1; 2/175.5; 2/183; 2/209.4

[58] Field of Search ..... 2/175.1, 175.5, 2/183, 209.4, 418, 420

[56] References Cited

U.S. PATENT DOCUMENTS

| | | | |
|---|---|---|---|
| 364,129 | 5/1887 | Plato | 2/175.5 |
| 478,952 | 7/1892 | Cohen | 2/175.5 |
| 742,731 | 10/1903 | Plato | 2/175.5 |
| 4,864,662 | 9/1989 | Frank | 2/183 |

*Primary Examiner*—Diana Biefeld

[57] ABSTRACT

A folding hat includes a crown and a brim which extends around the entire periphery of the crown. The brim is relatively stiff and flat so that it extends outwardly from the crown. The brim is provided with a hinge for folding the brim into a compact configuration for storage.

8 Claims, 6 Drawing Sheets

FOLDING HAT WITH STIFF SURROUNDING BRIM

BACKGROUND

This invention relates to hats, and, more particularly, to a hat with a stiff brim which surrounds the hat and which can be folded for storage.

The dangers of excessive sun are becoming more and more apparent. The problem is particularly severe for people who spend a substantial amount of time outdoors during the peak daylight hours of about 10:00 A.M. to 2:00 P.M. For example, golfers, fishermen, participants in other sports, construction workers, and many others risk excessive exposure to the harmful rays of the sun.

In order to reduce exposure to the sun's rays, many people where a hat. Baseball-style hats are popular with golfers and other sportsmen. However, the brim or bill of a baseball hat extends only from the front of the hat. The wearer therefore does not obtain protection for his ears, the sides of his face, or the back of his neck.

Straw hats have full brims which provide shade around the entire hat. However, straw hats may be blown away by even moderate wind and can be crushed when stored.

So-called floppy hats also have full brims, and the hats are crushable for easy storage. However, many persons do not like the appearance of floppy hats. For some people appearance is so important that they will wear a less protective hat rather than wear a hat which they perceive to have poor style.

SUMMARY OF THE INVENTION

The invention provides a hat with a full, stiff brim which provides shade around the entire hat and a neat, stylish look. The brim includes hinges so that the brim can be folded for compact storage.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
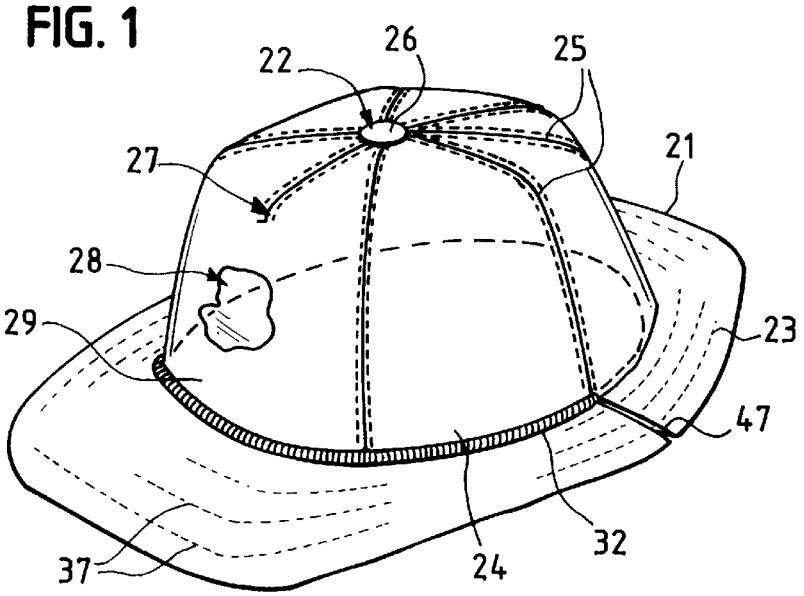
FIG. 1 is a perspective view of a hat formed in accordance with the invention.
Figure 2:
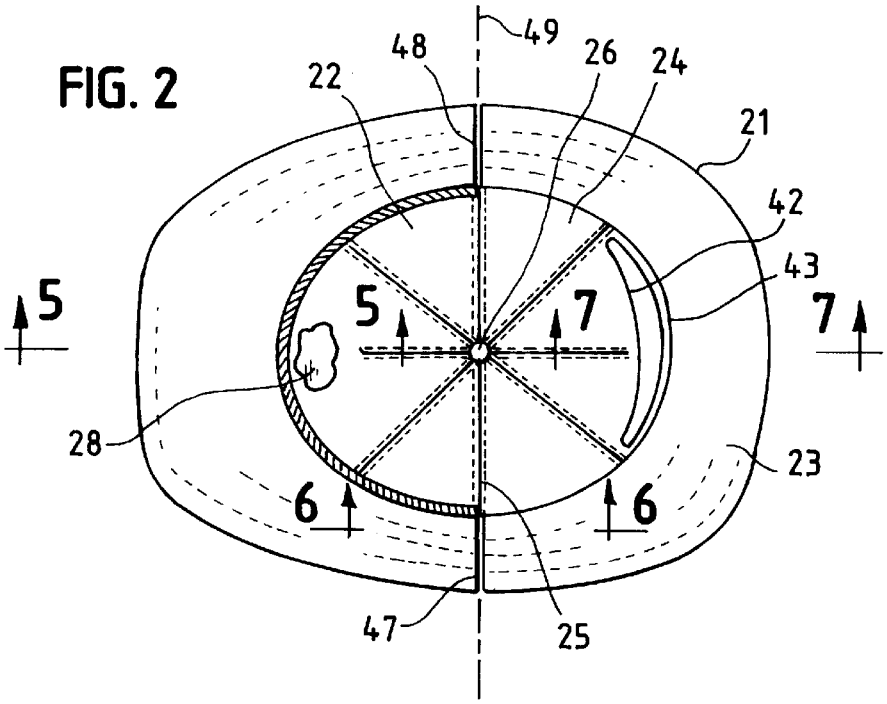
FIG. 2 is a top plan view of the hat of FIG. 1.
Figure 3:
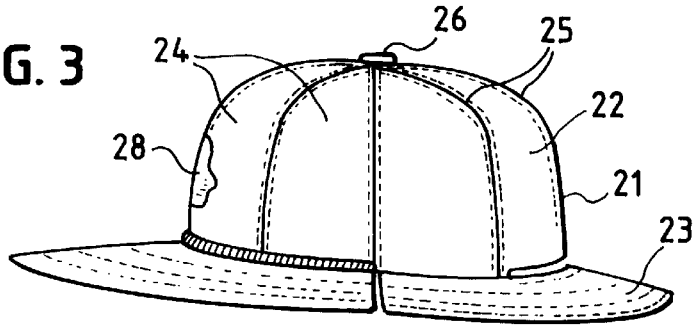
FIG. 3 is a left side view of the hat of FIG. 1.
Figure 4:
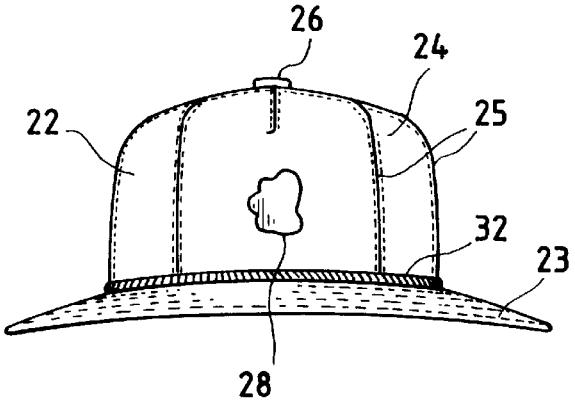
FIG. 4 is a front view of the hat of FIG. 1.

Referring to FIGS. 1–4, a hat 21 includes a crown 22 and a brim 23. The crown is generally dome-shaped for covering the head of a wearer and is advantageously made from the same cloth or fabric which is used in baseball-style hats. The crown is formed from a plurality of cloth panels 24 which are stitched together along seams 25. The seams converge at the top of the crown, and a decorative button 26 covers the point where the seams meet.

The crown may be shaped or styled by one or more pleats 27 which are folded and stitched. A decorative logo 28 may be attached to the front portion 29 of the crown.

Figure 5:
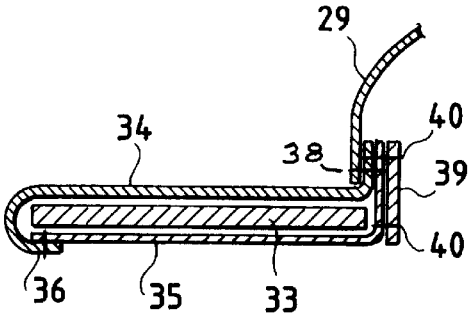
FIG. 5 is a fragmentary sectional view taken along the line 5—5 of FIG. 2.

The crown has a generally circular bottom edge 32 which extends around the crown, and the brim 23 extends generally radially outwardly from the crown. The brim is similar to the brim of a baseball hat but extends completely around the crown. The brim may also be constructed in the same manner as the brim of a baseball hat. Referring to FIG. 5, the brim includes a stiffening panel 33 which may be formed from cardboard, fiberboard, plastic or the like. The panel is covered by upper and lower layers 34 and 35 of cloth or fabric, and the upper layer extends around the outer edge of the stiffening panel and is secured by stitching 36. Additional lines of stitching 37 (FIG. 1) may be used to secure both layers of cloth to the panel. The inside edge of the brim may be attached to the crown in a conventional manner. The layers 34 and 35 are turned upwardly inside of the crown and are stitched to the crown at 38. A sweatband 39 can be secured to the upturned layers 34 and 35 by stitching 40.

Figure 7:
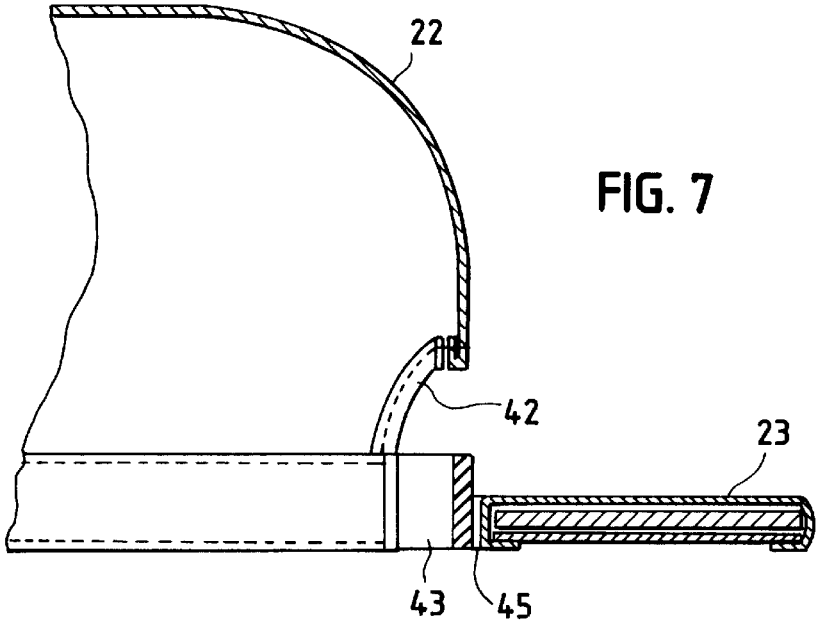
FIG. 7 is a fragmentary sectional view taken along the line 7—7 of FIG. 2.

Referring to FIG. 7, the rear of the crown is provided with a generally semicircular recess or notch 42. A conventional adjustable sizing band 43 extends across the bottom of the recess and is secured to the interior of the crown. The length of the band can be adjusted in a conventional manner, for example, by hook and loop fasteners, sold under the trademark VELCRO or by pins and holes, to adjust the size of the hat as desired.

The rear portion of the brim is provided with an inside free edge 45 which extends around the sizing band 43 but which is not secured to the band or to the crown. The sizing band can thereby be adjusted without interference from the brim.

Figure 6:
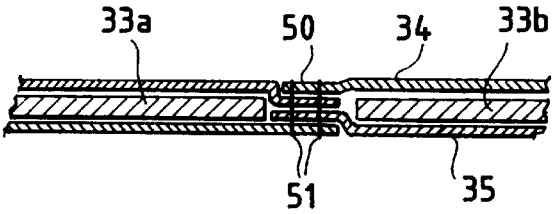
FIG. 6 is a fragmentary sectional view taken along the line 6—6 of FIG. 2.

The brim 23 is provided with at least a pair of hinges 47 and 48 (FIG. 2) so that the brim can be folded along at least one fold line 49. In the particular embodiment illustrated, the hinges 47 and 48 are created by using two separate stiffening panels, a front panel 33*a* and a rear panel 33*b* (FIG. 6) which are separated by a space 50 at each hinge. The upper and lower cloth layers 34 and 35 cover the spaces and are secured together in the spaces by stitching 51.

Since the cloth layers 34 and 35 and the cloth crown 22 are flexible, the brim 23 can be folded in half at the hinges along the fold line 49. The brim can be folded either upwardly or downwardly. In the latter event, the crown can either extend upwardly from the folded brim, or the crown can be tucked inside of the brim before the brim is folded.

When the hat is worn on the head of a wearer, the bottom edge 32 of the crown fits snugly around the head, and the brim 23 is maintained in the substantially flat, unfolded condition illustrated in FIGS. 1–4.

The cloth crown 22 and the cloth-covered relatively rigid brim 23 have the stylish appearance of a baseball-style hat. However, the full brim provides protection around the entire hat. In order to provide greater protection in the front and back, the front and back portions of the brim may be wider and extend farther from the crown than the side portions.

Figure 8:
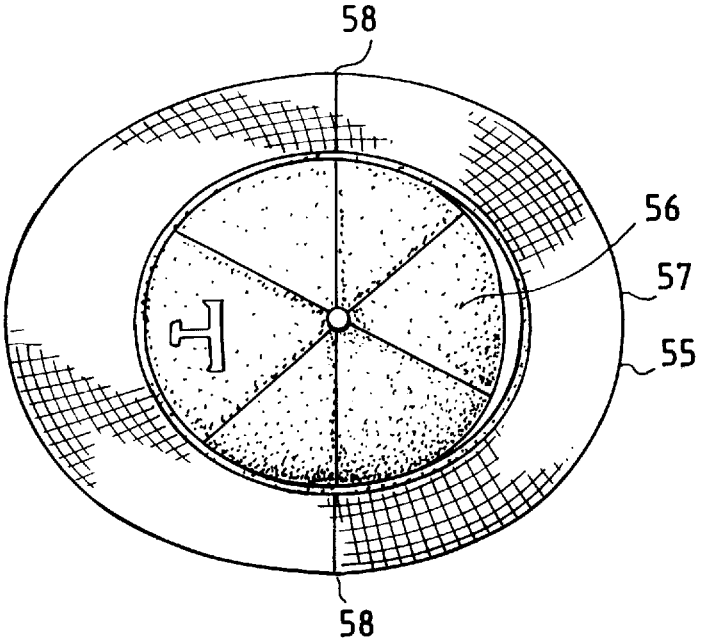
FIG. 8 is a top plan view of another embodiment of a hat formed in accordance with the invention.
Figure 9:
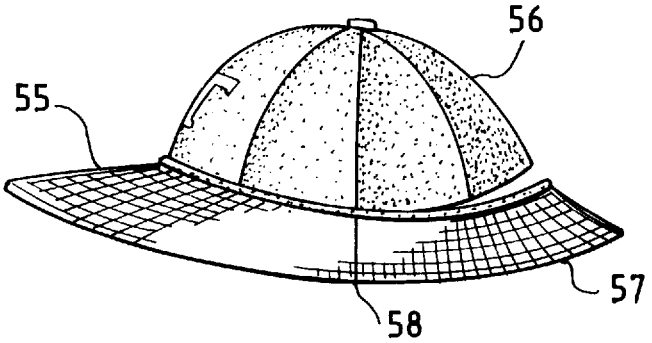
FIG. 9 is a side view of the hat of FIG. 8.
Figure 10:
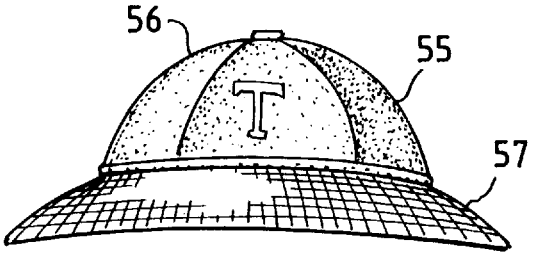
FIG. 10 is a front view of the hat of FIG. 8.

FIGS. 8–10 illustrate a slightly different style hat 55 which has an appearance similar to a tennis hat. The hat 55 also includes a flexible cloth crown 56 and a relatively rigid brim 57. The brim 57 is formed in the same manner as the brim 23 and includes a pair of hinges 58 in the side portions thereof.

Figure 11:
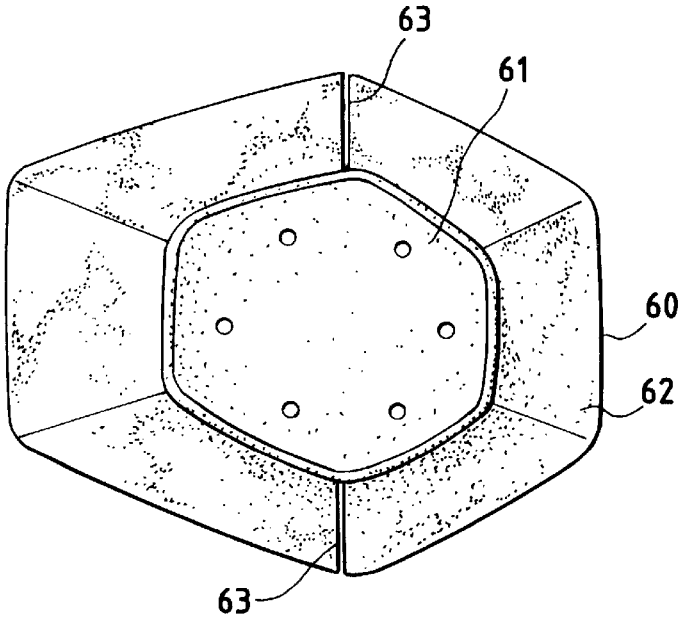
FIG. 11 is a top plan view of still another embodiment of a hat formed in accordance with the invention.
Figure 12:
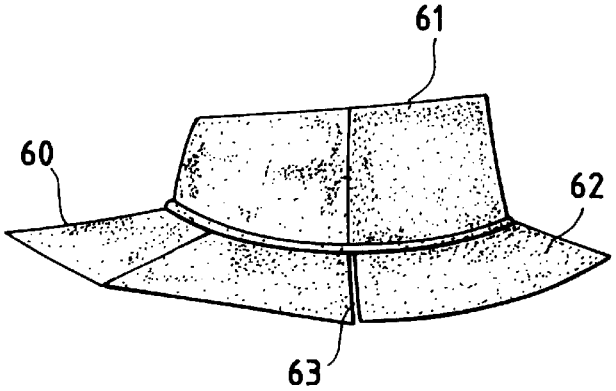
FIG. 12 is a side view of the hat of FIG. 11.
Figure 13:
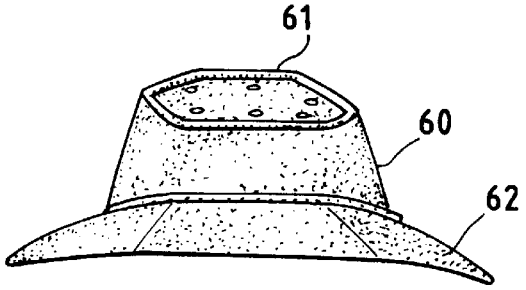
FIG. 13 is a front view of the hat of FIG. 11.

FIGS. 11–13 illustrate a military style hat 60 which includes a flexible cloth crown 61 and a relatively rigid brim 62. The periphery of the brim is polygonal, and the brim includes side hinges 63.

Figure 14:
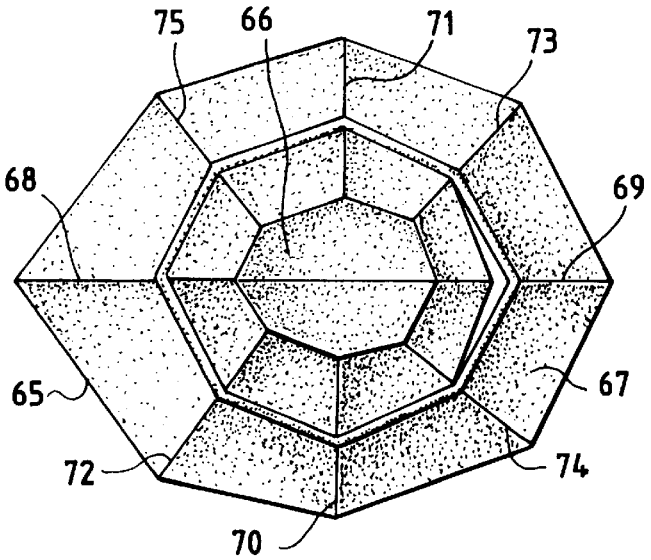
FIG. 14 is a top plan view of yet another embodiment of a hat formed in accordance with the invention.
Figure 15:
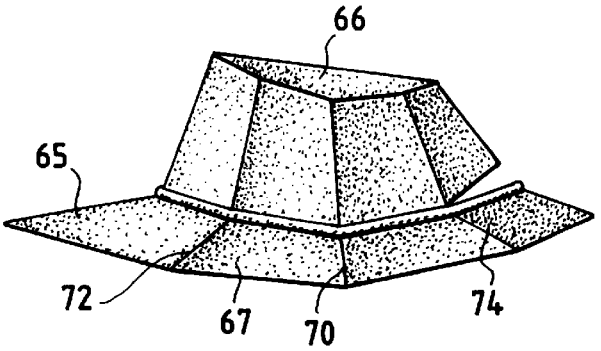
FIG. 15 is a side view of the hat of FIG. 14.
Figure 16:
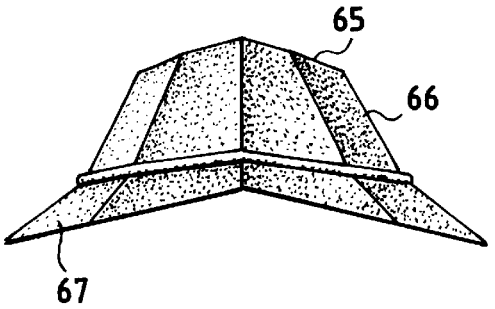
FIG. 16 is a front view of the hat of FIG. 14.

FIGS. 14–16 illustrate a hat 65 having multiple fold lines. The hat includes a flexible cloth crown 66 and a relatively rigid brim 67. The brim includes front and back hinges 68 and 69, side hinges 70 and 71, a first pair of diagonal hinges 72 and 73, and a second pair of diagonal hinges 74 and 75.

Figure 17:
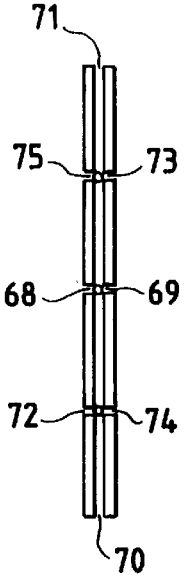
FIG. 17 illustrates the first fold of the hat of FIG. 14.
Figure 18:
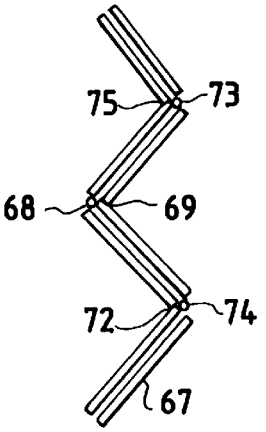
FIG. 18 illustrates subsequent folds of the hat of FIG. 14.
Figure 19:
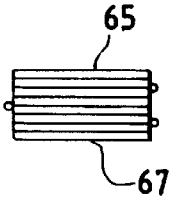
FIG. 19 illustrates the hat of FIG. 14 completely folded.

Referring to FIGS. 17–19, the hat 65 can be folded by tucking the crown inside the brim, folding the hat along either the front and back hinges 68 and 69 or the side hinges 70 and 71, and then folding the hat along the other hinges. The completely folded hat is illustrated in FIG. 19.

Figure 20:
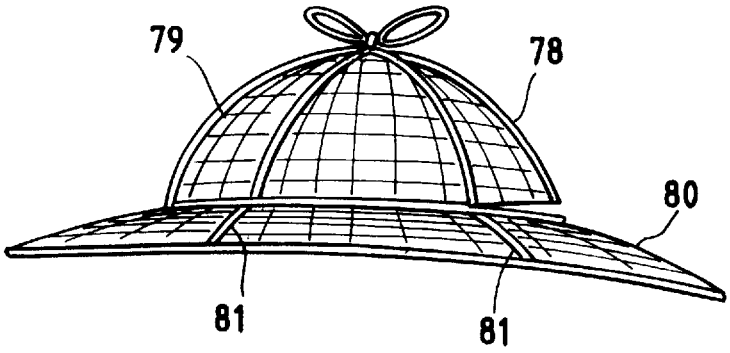
FIG. 20 illustrates still another embodiment of a hat formed in accordance with the invention.

FIG. 20 illustrates a Sherlock Holmes style hat 78 which includes a cloth crown 79 and a relatively rigid brim 80. The brim includes a pair of hinges 81.

The drawings show that many different styles of folding hats can be provided with a stiff brim which extends completely around the hat yet maintains the desired shape. Even though the stiff brim maintains its shape when the hat is worn, the hat can be folded into a compact configuration for storage.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A folding hat comprising:

a flexible and collapsible crown having a top portion and a bottom, generally round peripheral edge, the bottom edge having front, back, and opposite side portions, the crown being provided with a notch in the back of the bottom edge, a brim extending generally radially outwardly from the bottom edge of the crown around substantially the entire periphery thereof, the brim including stiffening means for maintaining the shape of the brim in a configuration which extends generally outwardly from the bottom edge and hinge means for permitting the brim to be folded, and an adjustable sizing band extending across the notch of the crown.

2. The hat of claim 1 in which the crown is made of fabric.

3. The hat of claim 1 in which the brim includes upper and lower layers of fabric and the stiffening means comprises a relatively flat panel which is sandwiched between the upper and lower layers of fabric.

4. The hat of claim 3 in which said panel is formed by at least two separate adjacent panel portions which are separated by at least two spaces, said hinge means being formed by securing the upper and lower layers of fabric together in said spaces.

5. The hat of claim 4 in which one of the said panel portions extends from the front portion and portions of the side portions of the bottom edge and another of said panel portions extends from the back and other portions of the side portions of the bottom edge, said spaces between the panel portions being positioned about midway between the front and back portions of the bottom edge.

6. The hat of claim 1 in which the brim includes a rear portion having an inside free edge which extends around the sizing band but which is not secured to the sizing band or to the crown.

7. A folding hat comprising:

a flexible and collapsible crown having a top portion and a bottom, generally round peripheral edge, the bottom edge having front, back, and opposite side portions, the crown being provided with a notch in the back of the bottom edge, a brim extending generally radially outwardly from the bottom edge of the crown around substantially the entire periphery thereof, the brim including upper and lower layers of fabric and at least two separate adjacent stiffening panels which are separated by at least two spaces and which are sandwiched between the upper and lower layers of fabric for maintaining the shape of the brim in a configuration which extends generally outwardly from the bottom edge, and hinge means formed by securing the upper and lower layers of fabric together in said spaces between adjacent stiffening panels for permitting the brim to be folded, one of the stiffening panels extending from the front portion and portions of the side portions of the bottom edge and another of the stiffening panels extending from the back and other portions of the side portions of the bottom edge, said spaces between the stiffening panels being positioned about midway between the front and back portions of the bottom edge, and an adjustable sizing band extending across the notch in the crown.

8. The hat of claim 7 in which the brim includes a rear portion having an inside free edge which extends around the sizing band but which is not secured to the sizing band or to the crown.

* * * * *